US008007317B2

(12) United States Patent
Su et al.

(10) Patent No.: US 8,007,317 B2
(45) Date of Patent: Aug. 30, 2011

(54) CABLE CONNECTOR ASSEMBLY WITH AN IMPROVED SHELL

(75) Inventors: Ping-Sheng Su, Tu-Cheng (TW); Jun Chen, Kunshan (CN); Feng-Jun Qi, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/635,721

(22) Filed: Dec. 11, 2009

(65) Prior Publication Data

US 2010/0151731 A1 Jun. 17, 2010

(30) Foreign Application Priority Data

Dec. 11, 2008 (CN) ..... 2008 2 0303320

(51) Int. Cl.
*H01R 13/648* (2006.01)

(52) U.S. Cl. ..... 439/607.46; 439/76.1; 439/607.48

(58) Field of Classification Search ..... 439/607.41–607.52, 607.55–607.57, 439/76.1
See application file for complete search history.

(56) References Cited

U.S. PATENT DOCUMENTS 6,705,894 B1 * 3/2004 Comerci et al. ..... 439/607.47

FOREIGN PATENT DOCUMENTS

CN 2390286 Y 8/2000

* cited by examiner

*Primary Examiner* — Ross N Gushi
(74) *Attorney, Agent, or Firm* — Wei Te Chung; Andrew C. Cheng; Ming Chieh Chang

(57) ABSTRACT

A cable connector assembly includes an insulative housing (1) having a number of contacts (2) received therein, a shielding member (3) enclosing the insulative housing, a printed circuit board (4) connected with tail portions of the contacts, a cable (5) connected with the printed circuit board, and a metallic shell (6) enclosing the printed circuit board. The metallic shell has a top shell (61) and a bottom shell (62) assembled to each other, and the metallic shell also defines a pair of blocking portions (625) bent from a front end thereof, the blocking portions are perpendicular to a mating direction and adjacent to a front surface of the shielding member.

17 Claims, 5 Drawing Sheets

CABLE CONNECTOR ASSEMBLY WITH AN IMPROVED SHELL

BACKGROUND OF THE INVENTION

1. Field of the Invention

The present invention generally relates to a cable connector assembly, and more particularly to a cable connector assembly used for video signal transmission.

2. Description of Related Art

Nowadays, cable connector assemblies are widely used in electronic devices, and the cable connector assembly usually defines a shielding mechanism to reduce the Electro Magnetic Interference (EMI). CN patent No. 2390286Y issued to Lai on Aug. 2, 2000 discloses a cable connector assembly, the cable connector assembly comprises an insulative housing, a plurality of contacts received in the insulative housing, a shell enclosing a mating port of the insulative housing, and a cover assembled on the insulative housing, the cable connector assembly also has a shielding member encircling a rear part of the insulative housing to shielding the electrical connection, the shell can shield the mating area of the insulative housing, but gaps are occurred around a front part of the shielding member, therefore the EMI maybe affect the signal transmission.

Correspondingly, it is desired to have a cable connector assembly with improved shielding member to address the problems stated above.

BRIEF SUMMARY OF THE INVENTION

Accordingly, an object of the present invention is to provide a cable connector assembly having an improved shell reducing Electro Magnetic Interference (EMI) in the signal transmission.

In order to achieve the above-mentioned object, a cable connector assembly in accordance with the present invention comprises an insulative housing having a plurality of contacts received therein, a shielding member enclosing the insulative housing, a printed circuit board connected with tail portions of the contacts, a cable connected with the printed circuit board, and a metallic shell enclosing the printed circuit board. The metallic shell has a top shell and a bottom shell assembled to each other, and the metallic shell also defines a pair of blocking portions bent from a front end thereof, the blocking portions are perpendicular to a mating direction and adjacent to a front surface of the shielding member.

Other objects, advantages and novel features of the invention will become more apparent from the following detailed description of the present embodiment when taken in conjunction with the accompanying drawings.

DETAILED DESCRIPTION OF THE INVENTION

Figure 1:
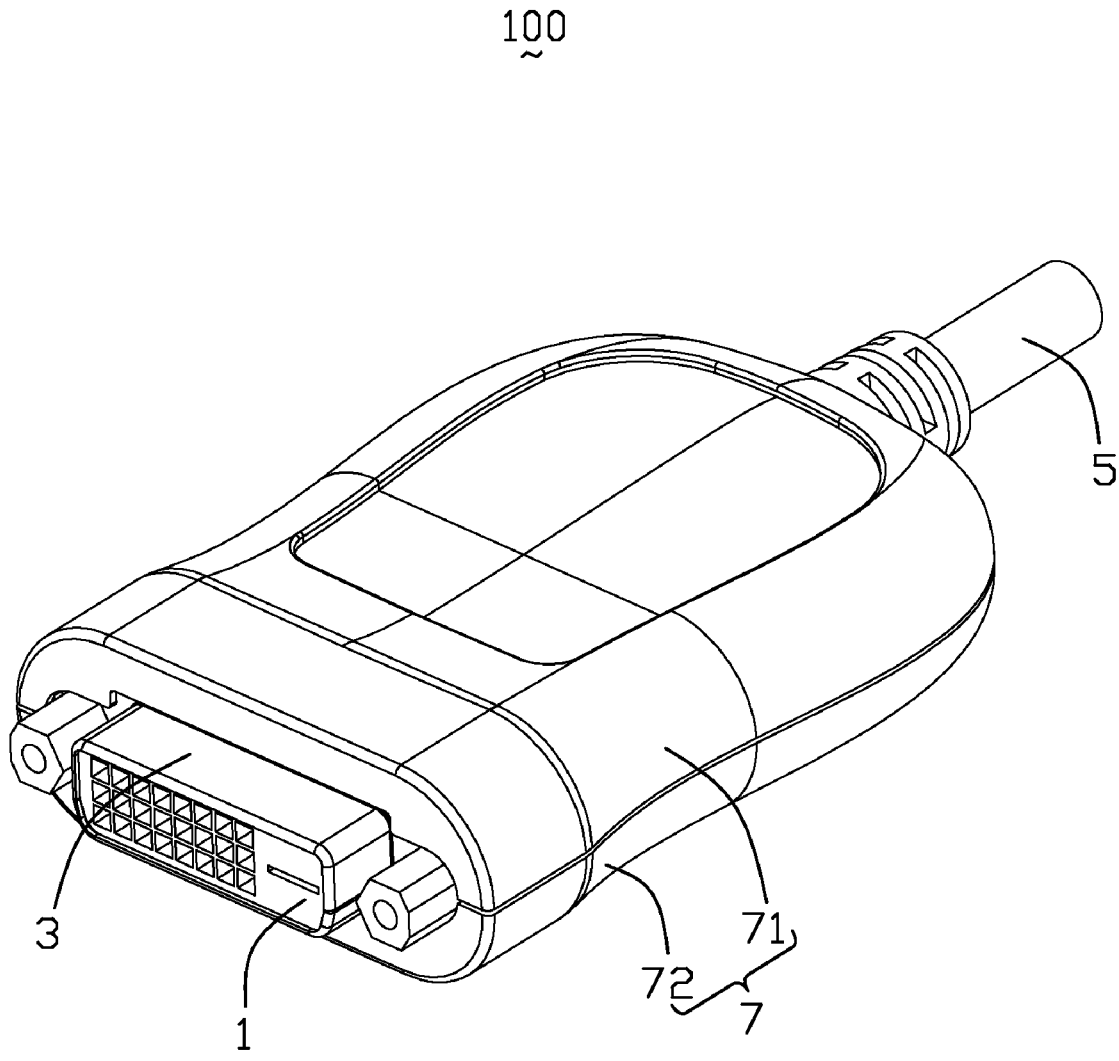
FIG. 1 is an assembled, perspective view of a cable connector assembly of the present invention.

Reference will now be made to the drawing figures to describe the present invention in detail.

Figure 2:
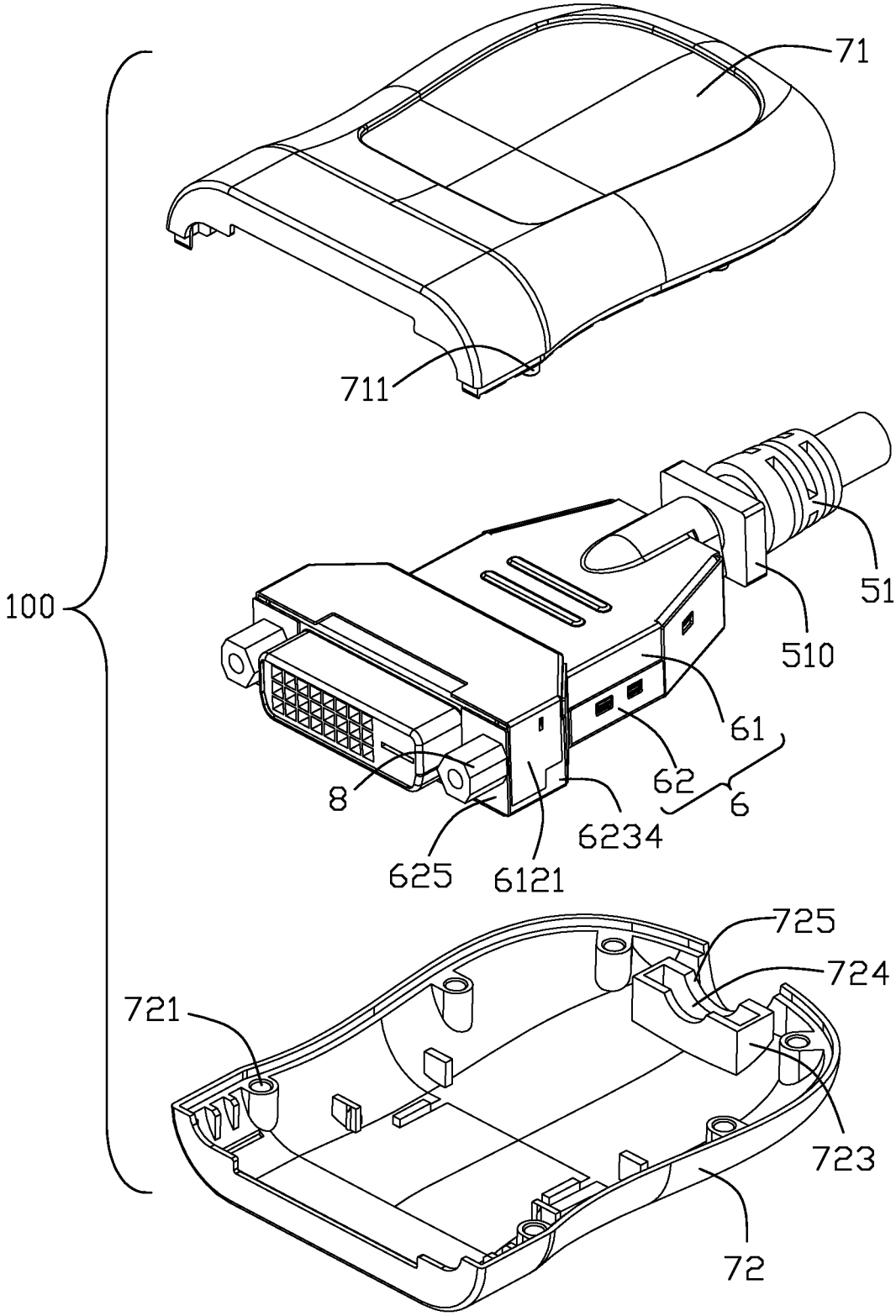
FIG. 2 is a partially exploded, perspective view of the cable connector assembly.
Figure 3:
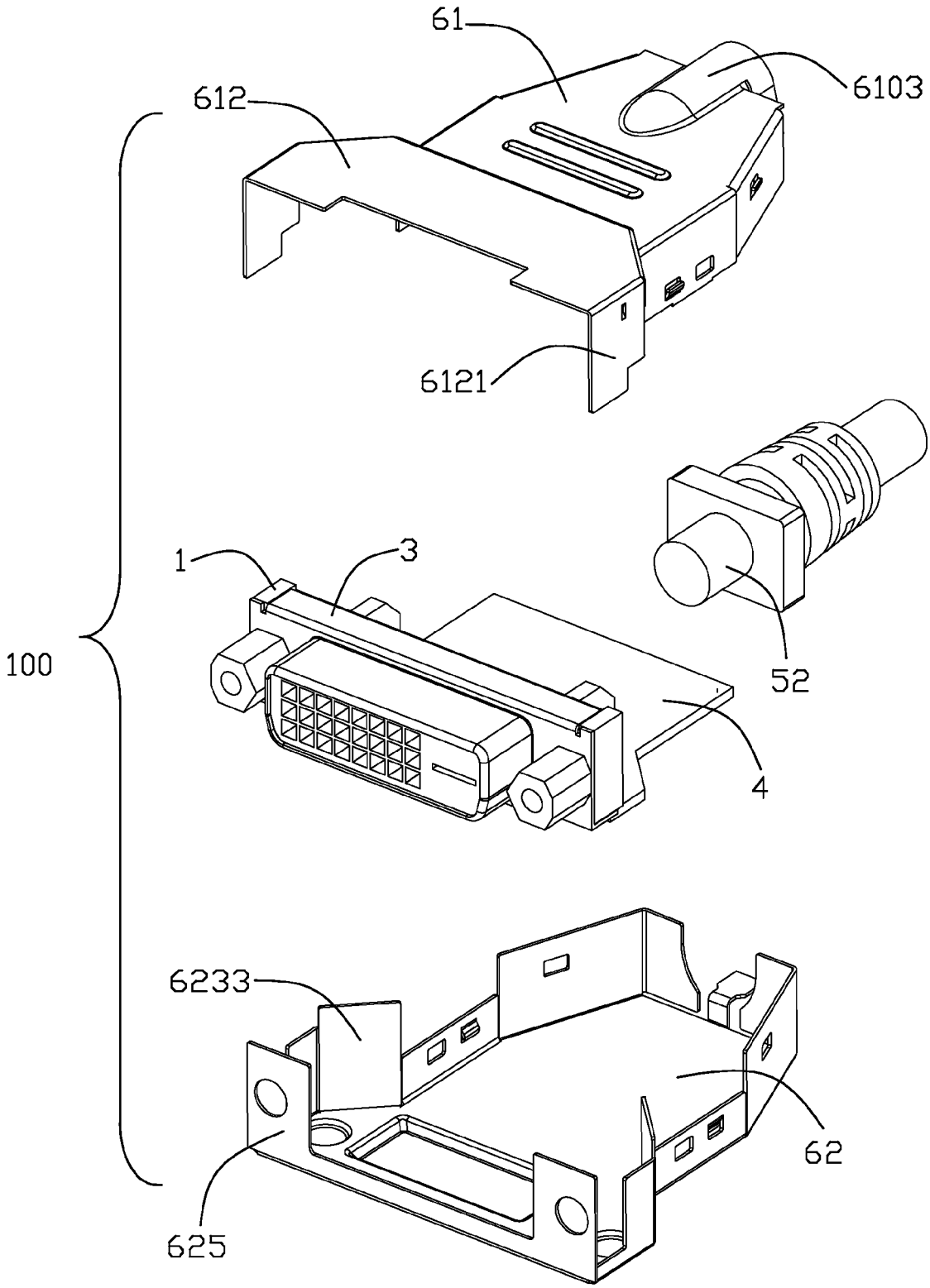
FIG. 3 is another exploded, perspective view of the cable connector assembly shown in FIG. 2.
Figure 4:
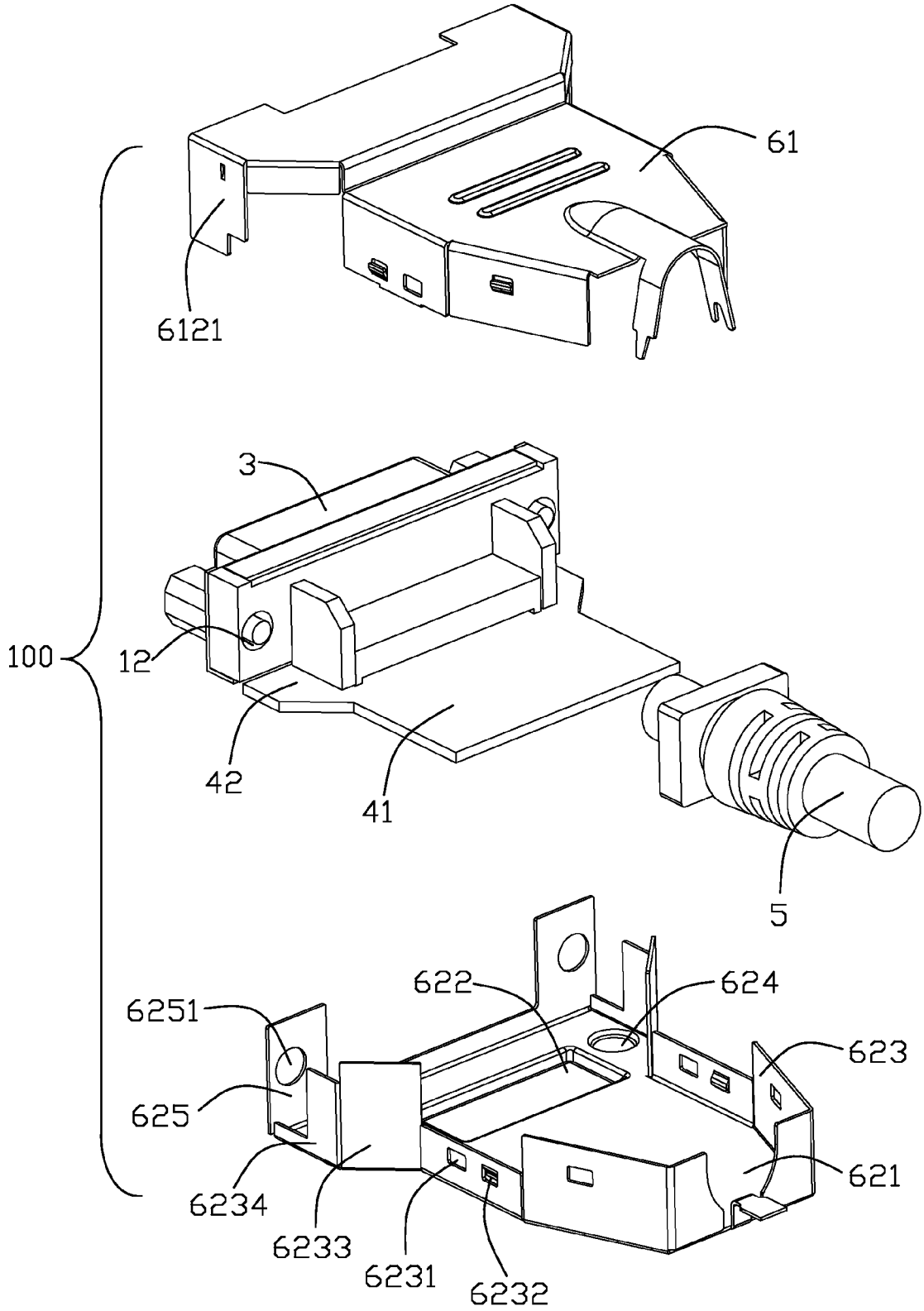
FIG. 4 is similar to FIG. 3, but viewed from another aspect.
Figure 5:
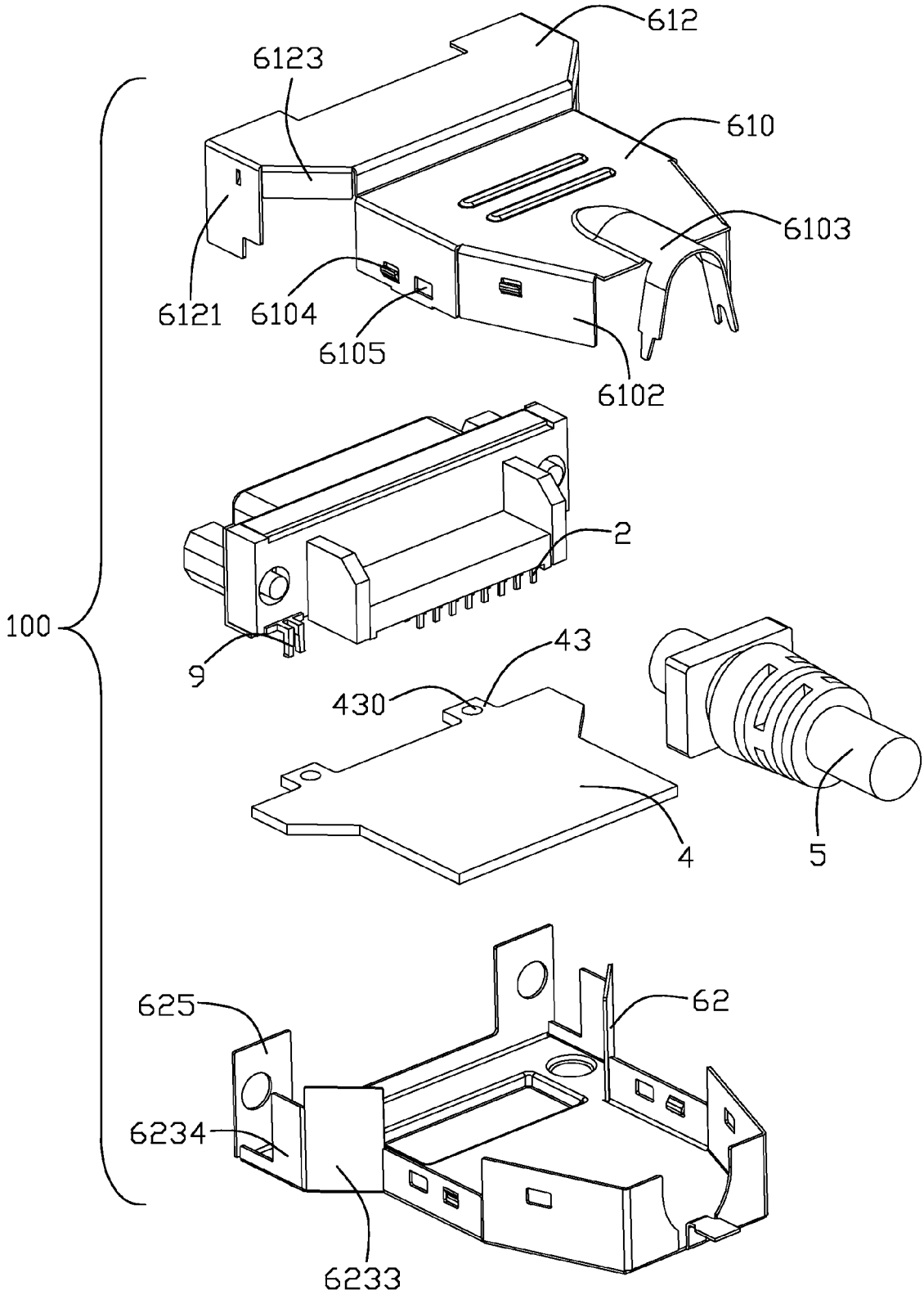
FIG. 5 is another exploded, perspective view of the cable connector assembly shown in FIG. 4.

Referring to FIGS. 1-3, a cable connector assembly 100 in accordance with the present invention comprises an insulative housing 1, a plurality of contacts 2 received in the insulative housing 1, a metallic shielding 3 enclosing a mating port of the insulative housing 1, a printed circuit board 4, a cable 5, a metallic shell 6 enclosing the printed circuit board 4 and the insulative housing 1, and a cover 7. The cover 7 is made of insulative material, and comprises an upper cover 71 and a lower cover 72 assembled to each other along an up-to-down direction.

Referring to FIGS. 2-5, the cable connector assembly 100 is compatible with Digital Visual Interface (DVI) transmitting protocol. The contacts 2 are assembled in the insulative housing 1, and tail portions of the contacts 2 are bent downwards and soldered to the printed circuit board 4.

The insulative housing 1 defines a pair of fastening holes 12 at opposite sides thereof, a pair of nuts 8 are mounted in the corresponding fastening holes 12 and coupled to a complementary connector (not shown). A metallic shielding member 3 is enclosing the insulative housing 1 and a mating port of the cable connector assembly 100 to reduce Electro Magnetic Interference (EMI). The shielding member 3 defines a pair of through holes (not shown) aligned with corresponding fastening holes 12, a pair of linking members (not shown) are arranged between the insulative housing 1 and lateral sides of the shielding member 3, and each linking member is bent downwardly to form a fork-shape linking leg 9.

The printed circuit board 4 includes a rectangular main portion 41 and a soldering portion 42 extending forwardly and enlarged outwards from the main portion 41, the soldering portion 42 defines a pair of rectangular projecting portions 43 extending forwards, and each projecting portion 43 has a locking hole 430.

The cable 5 defines a strain relief portion 51 on a front segment thereof and a plurality of wires (not shown), and a rectangular retaining portion 510 is defined on the strain relief portion 51.

The shell 6 is made of metallic material and comprises a top shell 61 and a bottom shell 62 assembled to each other. The top shell 61 comprises a base portion 610 and an extension portion 612 extending forwards from the base portion 610, the extension portion 612 is wider than the base portion 610 along a transverse direction. The base portion 610 defines a pair of side walls 6102 bent downwards from thereof and a holding portion 6103 extending backwards from thereof, and each side wall 6102 has a plurality of first tabs 6104 and a plurality of first latching holes 6105. The extension portion 612 defines a pair of first shading portions 6121 bent downwards from lateral sides thereof and a pair of second shading portions 6123 shorter than the first shading portions 6121.

The bottom shell 62 comprises a lower wall 621 and a pair of lateral walls 623 bent upwards from both sides of the lower wall 621. Each lateral wall 623 defines a plurality of second latching holes 6231 engaging with corresponding first tabs 6104 and a plurality of second tabs 6232 engaging with corresponding first latching holes 6105. The lower wall 621 is recessed to form a depression 622, and a pair of circular matching holes 624 are located on both sides of the depression 622. Each lateral wall 623 defines a third shading portion 6233 and a fourth shading portion 6234 located in front of the third shading portion 6233 and shorter than the third shading portion 6233. The lower wall 621 defines a pair of blocking portions 625 on a front end and lateral sides thereof, and each blocking portion 625 is bending upwards and perpendicular to a mating direction, each blocking portion 625 has a circular mounting hole 6251.

The upper cover 71 defines a plurality of posts 711 around an inner wall thereof equably, the lower cover 72 defines a plurality of engaging holes 721 cooperating with corresponding posts 711. The upper cover 71 and the lower cover 72 have the same configuration with each other, both of the upper cover 71 and the lower cover 72 define a clipping portion 723 on a rear end thereof and a receiving groove 724 disposed in the clipping portion 723 along the transverse direction, and an arc-shaped cutout 725 is recessed downwards from an upper surface of the clipping portion 723 to receive the cable 5.

In assembly, the contacts 2 are received in the insulative housing 1, tail portions (not labeled) of the contacts 2 are soldered to the soldering portion 42 of the printed circuit board 4, the shielding member 3 is enclosing the insulative housing 1, and the linking member is arranged between the insulative housing 1 and the shielding member 3. The wires of the cable 5 are soldered to the main portion 41 of the printed circuit board 4. The aforementioned elements are assembled into the bottom shell 62, the blocking portions 625 are adjacent to a front surface of the shielding member 3, the nuts 8 are protruding through corresponding mounting holes 6251 of the bottom shell 62, the through holes of the shielding member 3 and the fastening holes 12 of the insulative housing 1 to realize the mechanical connection therebetween. The linking legs 9 of the linking member are protruding through the locking holes 430 of the printed circuit board 4 to make the insulative housing 1 be mounted on the printed circuit board 4. The contacts 2 are extending through the printed circuit board 4 and aligning with the depression 622 of the bottom shell 62.

Then the top shell 61 is assembled to the bottom shell 62 along an up-to-down direction, a front section 52 of the cable 5 is accommodated in the holding portion 6103, the first tabs 6104 of the top shell 61 are locked in the corresponding second latching holes 6231 of the bottom shell 62, and the second tabs 6232 are received in the corresponding first latching holes 6105, thus the top shell 61 is locked with the bottom shell 62. The first shading portions 6121 of the top shell 61 are located out of the corresponding fourth shading portions 6234 of the bottom shell 62, and the third shading portions 6233 of the bottom shell 62 are located out of the corresponding second shading portions 6123 of the top shell 61. The extension portion 612 of the top shell 61 is shielding a rear portion of the insulative housing 1, and the base portion 610 is located on the main portion 41 of the printed circuit board 4. Therefore, the shell 6 is enclosing the shielding member 3, the insulative housing 1 and the electrical connection area to reduce EMI.

Then the cover 7 is assembled to the aforementioned elements, the retaining portion 510 of the cable 5 is disposed in the receiving groove 724 of the clipping portion 723 of the lower cover 72, and then the upper cover 71 is assembled to the lower cover 72, the posts 711 of the upper cover 71 are inserted into the corresponding engaging holes 721 of the lower cover 72. Thus, the cable connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing and a plurality of contacts received therein;

a shielding member enclosing the insulative housing;

a printed circuit board connected with tail portions of the contacts;

a cable connected with the printed circuit board; and a metallic shell enclosing the printed circuit board and having a top shell and a bottom shell assembled to each other, the metallic shell defining a pair of blocking portions bent from a front end thereof, the blocking portions perpendicular to a mating direction and adjacent to a front surface of the shielding member; wherein each blocking portion defines a mounting hole, the shielding member defines a pair of through holes aligning with the corresponding mounting holes, and the insulative housing has a pair of fastening holes aligning with the corresponding through holes and the mounting holes.

2. The cable connector assembly as claimed in claim 1, wherein the blocking portions are arranged on at least one of the top shell and bottom shell.

3. The cable connector assembly as claimed in claim 2, wherein both of the top shell and the bottom shell have a plurality of shading portions with different heights.

4. The cable connector assembly as claimed in claim 3, wherein the shading portions of the top shell and the bottom shell are alternately located neighboring to the printed circuit board.

5. The cable connector assembly as claimed in claim 1, wherein the bottom shell comprises a lower wall and a pair of lateral walls bent upwards from both sides of the lower wall, the lower wall defines a depression recessed downwards.

6. The cable connector assembly as claimed in claim 5, wherein the contacts are protruding through and soldered on the printed circuit board, and located above the depression of the bottom shell.

7. The cable connector assembly as claimed in claim 6, wherein the top shell comprises a base portion and an extension portion extending forwards from the base portion.

8. The cable connector assembly as claimed in claim 7, wherein the printed circuit board comprises a main portion and a soldering portion extending forwardly from the main portion and soldered to the contacts.

9. The cable connector assembly as claimed in claim 8, wherein the extension portion of the top shell is shielding a rear segment of the insulative housing, the base portion is located above the main portion of the printed circuit board.

10. The cable connector assembly as claimed in claim 9, wherein the soldering portion defines a pair of rectangular projecting portions extending forwards.

11. The cable connector assembly as claimed in claim 10, wherein a pair of linking member are arranged between the shielding member and the insulative housing, and each linking portion is bent downwardly to form with a fork-shape leg.

12. The cable connector assembly as claimed in claim 11, wherein the legs are protruding through the printed circuit board.

13. A cable connector assembly comprising:

an insulative housing defining a mating port;

a plurality of contacts disposed in the housing with contacting sections extending into the mating port;

a metallic shielding member covering a front portion of the housing including said mating port;

a pair of metallic top and bottom shells enclosing said housing except said mating port in a front-to-back direction; and a cable located behind and electrically connected to the connector; wherein said top shell and said bottom shell define a pair of blocking potions at two opposite sides of the mating port in a transverse direction perpendicular to said front-to-back direction, and rearwardly abutting against two opposite ends regions of the shielding member via a pair of screws extending through the corresponding blocking portions and end regions, respectively, in said front-to-back direction.

14. The cable connector assembly as claimed in claim 13, further including a printed circuit board with opposite front and rear ends thereof in said front-to-back direction, to which the connector and wires are mechanically and electrically connected, respectively.

15. The cable connector assembly as claimed in claim 14, wherein the connector is equipped with board locks securing the connector to the printed circuit board.

16. The cable connector assembly as claimed in claim 15, wherein said front end of said printed circuit board is relatively larger than other portion thereof for compliance with a connector configuration.

17. The cable connector assembly as claimed in claim 13, wherein said pair of blocking portions are derived from only one of said top shell and said bottom shell.

* * * * *